United States Patent [19]

Jaenke, deceased et al.

[11] 4,223,653

[45] Sep. 23, 1980

[54] CONTROL APPARATUS FOR LIMITING THE FUEL SUPPLY QUANTITY OF A FUEL INJECTION PUMP FOR INTERNAL COMBUSTION ENGINES

[75] Inventors: Hans-Jürgen A. W. Jaenke, deceased, late of Ditzingen, Fed. Rep. of Germany, by Else M. K. Jaenke, legal representative, Birge M. Jaenke, Ann K. Jaenke, heirs; Ernst Ritter; Reinhard Schwartz, both of Stuttgart, Fed. Rep. of Germany; Klaus Schmidt, Vaihingen, Fed. Rep. of Germany

[73] Assignee: Robert Bosch GmbH, Stuttgart, Fed. Rep. of Germany

[21] Appl. No.: 18,210

[22] Filed: Mar. 7, 1979

[30] Foreign Application Priority Data

Apr. 1, 1978 [DE] Fed. Rep. of Germany ..... 2814146

[51] Int. Cl.[3] ..... F02M 39/00

[52] U.S. Cl. ..... 123/366; 123/379; 123/382

[58] Field of Search ..... 123/139 ST, 179 L, 179 G, 123/140 MC, 140 FG, 140 R

[56] References Cited

U.S. PATENT DOCUMENTS

| | | | |
|---|---|---|---|
| 2,895,465 | 7/1959 | Humber | 123/140 FG |
| 3,311,101 | 3/1967 | Huse | 123/179 L |
| 3,311,102 | 3/1967 | Voigt | 123/179 L |
| 3,557,765 | 1/1971 | Nystrom | 123/179 L |
| 3,699,941 | 10/1972 | Hughes | 123/140 MC |
| 3,707,144 | 12/1972 | Galis | 123/179 L |
| 3,960,127 | 6/1976 | Vuaille | 123/140 FG |
| 4,099,506 | 7/1978 | Kolb | 123/139 ST |
| 4,143,634 | 3/1979 | Ritter | 123/179 L |
| 4,160,434 | 7/1979 | Daborowski | 123/139 ST |

FOREIGN PATENT DOCUMENTS

| | | | |
|---|---|---|---|
| 499157 | 1/1939 | United Kingdom | 123/140 MC |

*Primary Examiner*—Charles J. Myhre
*Assistant Examiner*—Carl Stuart Miller
*Attorney, Agent, or Firm*—Edwin E. Greigg

[57] ABSTRACT

A control apparatus for limiting the fuel supply quantity of a fuel injection pump for internal combustion engines such as Diesel engines or the like by means of which an automatically controlled additional starting quantity of fuel is variable in accordance with temperature which comprises a limit stop displaceable by the pressure of a control medium and connected with a control piston and including a starting detent which varies its position in accordance with temperature; the limit stop in its first terminal position being arranged to determine the starting setting and in its other terminal position under the control of the pressure of the control medium, being arranged to determine the full-load setting of the fuel supply quantity adjustment member of the injection pump, a starting setting for a warm engine being controlled by the starting detent which limits the starting setting to the full-load setting or below.

8 Claims, 6 Drawing Figures

Fig. 3
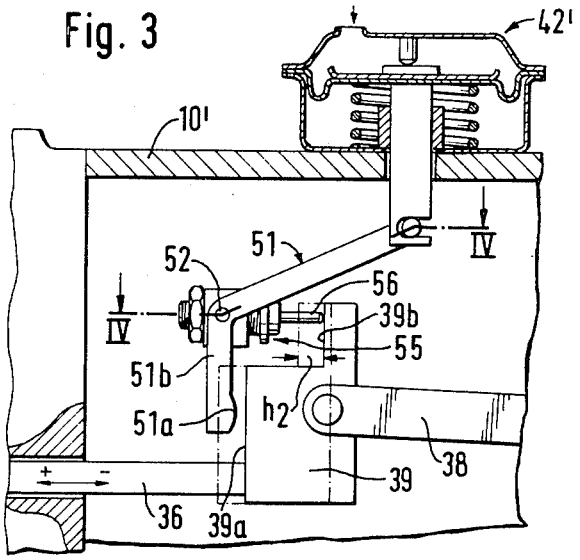
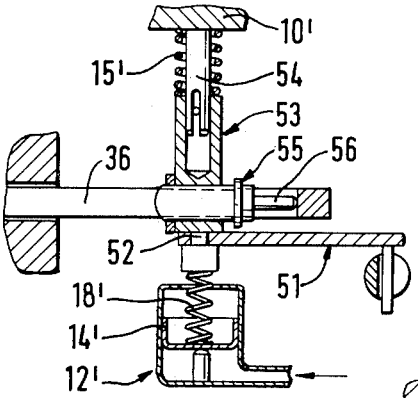
Fig. 4
Fig. 5
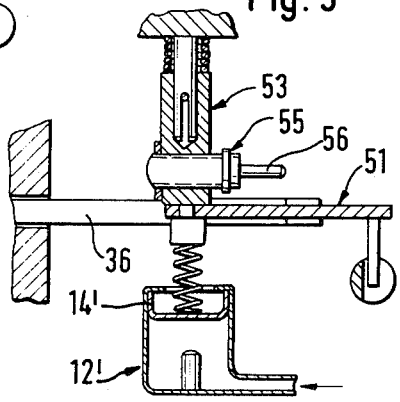

CONTROL APPARATUS FOR LIMITING THE FUEL SUPPLY QUANTITY OF A FUEL INJECTION PUMP FOR INTERNAL COMBUSTION ENGINES

BACKGROUND OF THE INVENTION

In a known control apparatus of this type (German Auslegeschrift No 1,220,200), where the limit stop is displaced immediately after starting, by means of the supply pressure generated at that time, into its terminal position which limits the full-load setting, the supply quantity adjustment member can proceed only into a firmly set, constant starting position as a result of the terminal position previously effected by the return spring upon engine shutoff. This starting position must be adjusted to an additional-quantity setting which exceeds the full-load position in order to assure a smooth cold start; however, when the engine is warm, this is no longer needed and unnecessarily increases fuel consumption and above all causes a puff of smoke which impermissibly increases the emission values.

Another apparatus is also already known (British Pat. No. 529,671) whose limit stops, which are displaceable in accordance with temperature, reduce the starting position designed for the cold engine down to the full-load position. These stops have the disadvantage, however, when they are mechanically actuated, that the regulator rod of the injection pump is not limited to the full-load position until the engine has attained its full operating temperature; and when there is a sudden drop in rpm (stalling mode), then the additional starting quantity which exceeds the permissible full-load quantity can also be injected during the driving mode, which leads to excessive and impermissible smoke formation in the engine. An electrically controlled variant embodiment of these known controls enables a limitation during the driving mode to the full-load quantity, this limitation being controlled electrically and in accordance with temperature. However, the technical expenditure is very high; when there are interruptions in the supply of current to the associated electromagnet, the additional starting quantity can no longer be controlled; and the magnetic armature, which is embodied with play for reasons of function, cannot be used as a full-load stop.

A further control appartus is also known, in which the limit stop is pivotable about a bearing axis which is disposed in a displacement direction of the limit stop by means of a control member operating in accordance with, for example, the charge pressure of the engine, and thus the limit stop varies the position of the full-load stop. In order to permit an additional starting quantity, this limit stop is displaceable in the direction of its axis; however, a reduction of the starting position controlled by the limit stop in accordance with the operating temperature of the engine or with the ambient temperature is also impossible in this apparatus.

OBJECT AND SUMMARY OF THE INVENTION

The control apparatus according to the invention has the advantage over the prior art that while the function of an rpm-dependent withdrawal of the limit stop from the starting position into the full-load position is retained, a temperature-dependent reduction of the additional starting quantity can be controlled for the engine which is at operational temperature.

By means of the characteristics of the dependent claims, advantageous further embodiments of the control apparatus disclosed in the main claim are possible. A space-saving structure is produced for the limit stop by the structural elements recited in claim 2, and an unhindered withdrawal of the supply quantity adjustment member out of its starting position is attained by means of a control apparatus such as that disclosed in claim 3. Without restriction of the rpm- and temperature-dependent limitation of the position of the supply quantity adjustment member, the full-load position of the supply quantity adjustment member can be adjusted in dependence on a further operational variable of the engine if the control apparatus is embodied in accordance with the revelations of claim 6 and, more particularly, in accordance with claim 7.

By means of a control apparatus, the limit stop of which is actuatable by the control member, and is displaceable perpendicular to the direction of motion of the supply quantity adjustment member, the starting position of the supply quantity adjustment member can be continuously withdrawn to any desired, reduced starting position below the cold start position by means of the starting detent which acts in accordance with temperature in the direction of the longitudinal axis of the supply quantity adjustment member. By this means, a starting position can be controlled for the warm engine as well which is below the full-load position.

The invention will be better understood as well as further objects and advantages thereof become more apparent from the ensuing detailed description of preferred embodiments taken in conjunction with the drawings.

BRIEF DESCRIPTION OF THE DRAWINGS

FIG. 3 is a schematic representation of the third embodiment of the invention;

FIG. 4 is a section taken along the line IV—IV of FIG. 3;

FIG. 5 is a section corresponding to FIG. 4, but with the limit stop actuated by the hydraulic control member and located in the full-load position.

DESCRIPTION OF THE PREFERRED EMBODIMENTS

Figure 1:
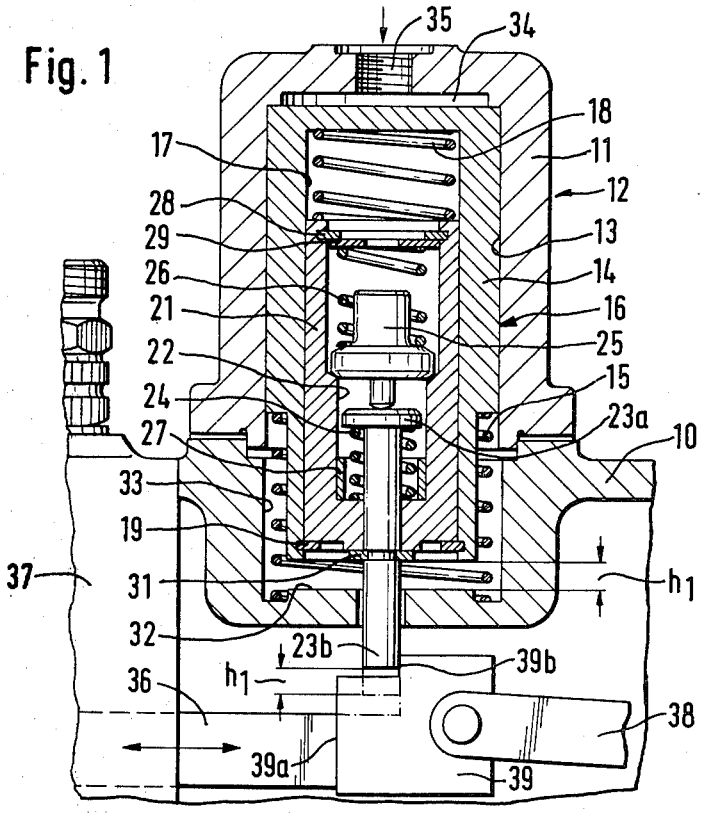
FIG. 1 shows in cross section a detailed view of the first embodiment of a control apparatus in accordance with the invention, which is mounted on the housing of an rpm governor of an injection pump.

The first embodiment illustrated in FIG. 1 shows a control apparatus 12 projecting partially into the governor housing 10 of a centrifugal rpm governor and otherwise having its housing 11 flanged onto the governor housing 10. The housing 11 contains a cylindrical bore 13, within which a hydraulically actuatable control piston 14 which serves as the control member is displaceably guided against the force of a return spring 15. This control piston 14 is part of a limit stop 16 and contains, within a central blind bore 17 open toward the governor housing 10, a deviation piston 21 which is held by a deviation spring 18 in its illustrated position of rest on a snap ring 19 which serves as a stop. Within a stepped central bore 22 of the deviation piston 21 there are placed a control pin 23 with an encompassing return spring 24, an expansible element 25 with a restraining spring 26 positioned thereabove and an annular stroke limit stop 27 for the control pin 23, as well as a snap ring 28 arranged to hold the entire structural group within the bore 22. It will be observed that the restraining spring 26 is supported on the snap ring 28 via a disc 29. The control pin 23 further bears a safety disc 31 acting as a stroke limit stop in both directions. This stop limits the stroke of the control pin 23 in the direction of the expansible element 25 and in the direction of a stroke limit stop 32 attached to the housing within a bore 33 of the governor housing 10 which also contains the return spring 15. The control stroke of the control pin 23, marked as $h_1$, can be performed by the control pin 23, when the control piston 14 is stopped in the illustrated position, as result of the expansion of the expansible element 25. This control stroke $h_1$ is simultaneously also the maximum stroke which can be performed by the control piston 14 actuated by the engine oil pressure. The engine oil pressure which serves as the control medium is supplied via a connecting bore 35 to a control pressure chamber 34 located above the control piston at the end of the cylindrical bore 13.

In order to assure that the control stroke of the control pin 23 effected by the expansible element 25 is identical to the stroke of the control piston 14, the annular stroke limit stop 27 is inserted into the portion of the bore 22 beneath a head **23*a* of the control pin 23**.

The control pin 23 performing the control stroke $h_1$ projects with its end **23*b* into the interior of the governor housing 10 and simultaneously acts as a full-load stop and as a temperature dependent starting detent for the supply quantity adjustment member 36, embodied as a regulator rod, of a fuel injection pump 37, which is shown only in part. The regulator rod 36, which is longitudinally displaceable in a known manner via a tongue 38 of the rpm governor (which will not be described in further detail) is provided with a counterstop 39, one step 39*a* of which is arranged to rest on the control pin 23 in order to limit the full-load position of the regulator rod 36 and the other step 39*b* of which, as shown, determines the starting position of the regulator rod 36. The second step 39*b*** may also be omitted if, as is known, the maximum possible terminal position of the regulator rod is selected, in which a starting groove on the pump piston controls the required starting quantity.

Figure 2:
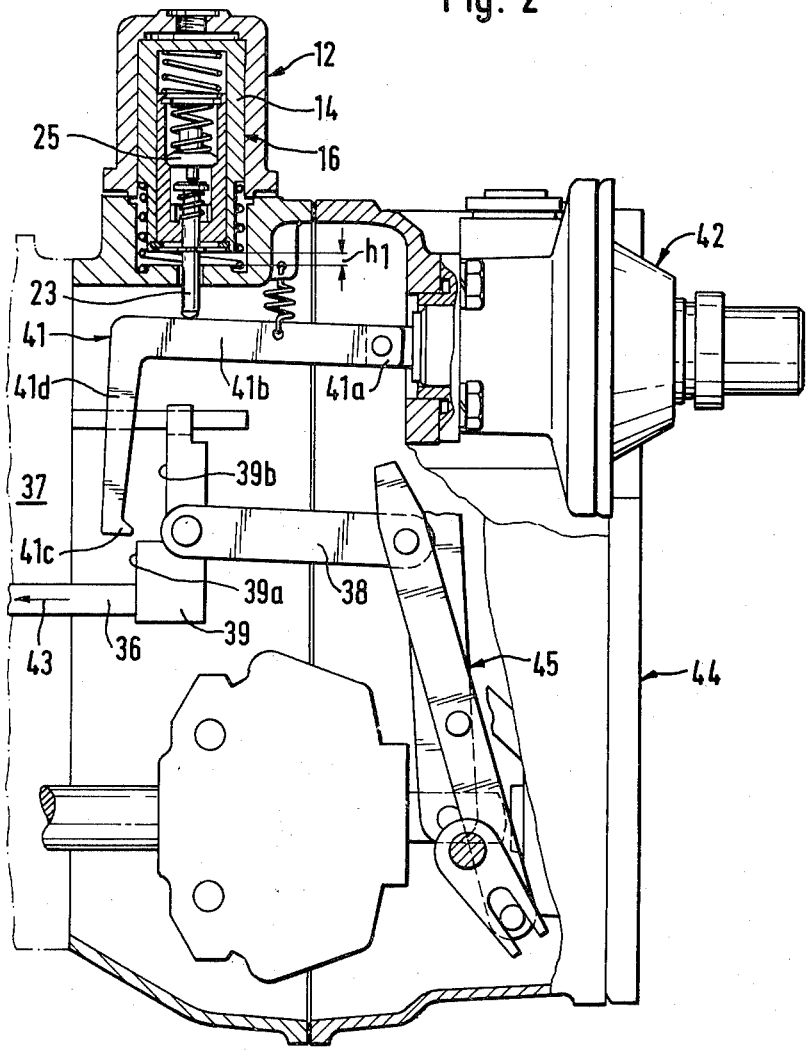
FIG. 2 is the second embodiment of the invention showing an rpm governor generally in an outline form and provided with a cross-sectional view of a second control member.

The exemplary embodiment shown in FIG. 2 contains the same control apparatus 12 as the first embodiment; however, the control stroke $h_1$ of the control pin 23 which is actuatable in accordance with temperature is transmitted to the regulator rod 36 of the injection pump 37 with the interposition of a hook-shaped stop lever 41. A charge-pressure-dependent full-load stop 42 which serves as a second control member engages the end **41*a* of the one, approximately horizontal, leg 41*b* of the stop lever 41. Accordingly, this adjusts the stop lever 41 parallel to the direction of displacement of the regulator rod 36, while the control pin 23 of the limit stop 16 of the control apparatus 12, which stop 16 serves as the first control member, causes a pivoting motion of the stop lever 41. By this means, the end 41*c* of the other, approximately perpendicularly disposed, leg 41*d* of the stop lever 41, which end forms the starting and full-load stop, is moved into the path of the counterstop 39 secured by the regulator rod 36. Thus, when the control pin 23 is displaced in accordance with temperature, this end 41*c* moves into the path of the step 39*a* of counterstop 39. In the illustrated at rest position shown of the control pin 23, which position the control pin 23 assumes when the control piston 14 is not actuated by the pressure of the control medium and hence is in the illustrated position and also when the control pin 23 is not actuated by the expansible element 25, then the end 41*c* of the leg 41*d* cooperates with the second step 39*b* of the counterstop 39. As was referred to earlier herein in connection with FIG. 1, this second step 39*b* may be omitted or may be recessed to such an extent that the regulator rod 36 can proceed, upon cold starting, into its maximum possible terminal position of displacement toward the left as viewed in the drawing (see arrow 43). A precisely preset additional starting quantity or the corresponding regulator rod path can be attained by setting the distance between the steps 39*a* and 39*b* accordingly. The centrifugal rpm governor 44 indicated only in part may be of any desired structure; however, a drag member (not shown) must be present within the associated regulator rod 45 which permits relative motions between the regulator rod 36 and this regulator rod 45 during control movements of the second control member 42 and also when the regulator rod 36 is fully blocked in the full-load position. To this end, the tongue 38** may be embodied as a resilient member in a known manner.

The third embodiment shown in simplified form in FIGS. 3–5 contains, like the second embodiment of FIG. 2, a full-load stop 42' acting in accordance with charge pressure and serving as the second control member, which cooperates via a bell crank 51 with the first step **39*a* of the counterstop 39 of the regulator rod 36. The bell crank 51 is supported with its pivotal bearing 52 on the limit stop, here indicated by reference numeral 53. This limit stop 53 is displaceable by the control piston 14' of the control apparatus 12', which serves as the first control member, against the force of the return spring 15' perpendicular to the direction of motion of the regulator rod 36. The control piston 14' transfers its control force via the deviation spring 18' onto the limit stop 53, which is displaceably supported on a shaft 54 secured on the governor housing 10'**.

The deviation spring 18' serves to prevent the regulator rod 36 from being held fast by the limit stop when the limit stop is displaced by the control piston 14' out of the position of rest shown in FIG. 4, that is, the starting position in which it is not subjected to the pressure of the control medium, into the full-load position shown in FIG. 5, where it is displaced by the pressure of the control medium. The deviation spring 18' is designed to be so soft for this purpose that when the regulator rod 36 is standing in the starting position the bell crank 51 can lie laterally against the regulator rod 36 until the latter is drawn back by the rpm governor out of the starting position until it is in or below the full-load position, and the stop lever 51 can proceed into the position shown in FIG. 5. In the position of the stop lever 51 as shown in FIG. 5, the end **51*a* of the first leg 51*b* acts as a full-load stop for the 39*a* of the counterstop 39, and this full-load position is correctable in accordance with charge pressure by means of the second control member 42' and the pivotal movement of the bell crank 51 caused by the member 42'**.

A starting detent 55 is screwed into the limit stop 53 perpendicular to the longitudinal axis, extending in the displacement direction, of the limit stop 53 and parallel to the longitudinal axis of the regulator rod 36. This starting detent 55 is adjustably secured in the direction of movement and varies its length in accordance with temperature. The control pin 56 of this starting detent 55 is displaceable in accordance with temperature in a similar manner to the control pin 23 of the embodiments described above by an expansible element which is disposed within the starting detent 55. The possible variation in length of the control pin 56 is indicated as $h_2$ in FIG. 3, and the counterstop 39 shown in its extended position and the second step 39*b* thereof which limits the starting position are in a reduced starting position required for the engine at operational temperature. In the present case, this starting position lies below the full-load position determined by the stop 51*a*. In contrast, a second starting position for the cold engine can be controlled which exceeds the full-load position and is indicated in the drawing with dot-dash lines. Thus, in contrast to the on-off switching which is the only control possibility in FIGS. 1 and 2, here a continuous reduction of the additional starting quantity is attainable even to below the full-load position.

The stop lever 51 which is embodied as a bell crank may either be pivotable about the pivoting bearing 52, as already described, to which end then the limit stop 53 must be guided on the shaft 54, secured against twisting, as shown; or the stop lever 51 is secured onto the limit stop 53 within the bearing point 52 and the entire stop 53 is pivotable in accordance with charge pressure by means of the second control member 42' for the purpose of varying the position of the end 52*a* serving as the full-load stop. Since the charge pressure only builds up after the starting procedure, this pivoting movement has no influence on the control motion of the control pin 56 of the starting detent 55, and in the full-load position of the limit stop 53 (see FIG. 5), the starting detent 55 is laterally displaced with respect to the counterstop 39 and does not influence the control of the full-load position of the regulator rod 36.

Figure 6:
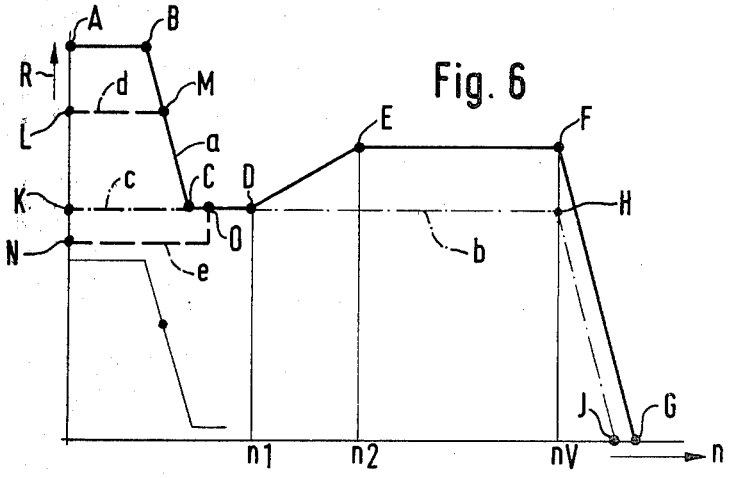
FIG. 6 is a regulator path-rpm explaining the function of the control apparatus embodied in accordance with the invention.

The regulator path-rpm diagram of FIG. 6 serves to explain the function of the control apparatus according to the invention, with the regulator path R of the regulator rod 36 of the injection pump 37 entered over the rpm n. The thickly drawn curve a indicates the rpm-dependent course of the regulator path of an rpm governor provided with the control apparatus 12 or 12' for the engine being started when cold between the regulator path points A through G, while the thin, dot-dash partial curve b between the points D, H, and J indicates the deviating course at full load for an rpm regulator equipped in accordance with FIG. 1 without charge-pressure stop. The thick, dot-dash curve portion c between points K and C represents the starting curve for the warm start of an rpm governor equipped with the control apparatus 12 according to FIGS. 1 and 2. Finally, a starting procedure corresponding to the thick broken-line curve portions d and e between points L and M and points N and O, respectively, can be controlled in an engine which is partially or completely at operating temperature by means of the control apparatus 12' of the third embodiment in accordance with FIGS. 3–5.

The mode of operation of the embodiments described above will now be described with the aid of the diagram of FIG. 6 and FIGS. 1 or 2 or 3–5 associated with the various embodiments.

In the first embodiment represented in FIG. 1, starting takes place in a cold engine at a regulator rod position, determined by the point A, which is as large as possible. This additional starting quantity is maintained by the injection pump up to point B, and as the rpm further increase, it is reduced to point C under the control of a starting or idling spring. This regulator rod position which limits the full-load quantity for operation as a suction engine is maintained between the points C and D and H up to the full-load rpm $n_V$. Between H and J, the shutoff of regulation, or deregulation, takes place, which is of no further interest here. Until the rpm $n_1$ is attained, the engine oil pressure introduced into the control pressure chamber 34 of the control apparatus 12 has increased to such an extent that it has displaced the control piston 14 and thus the entire limit stop 16 against the force of the return spring 15, so that the control pin 23, after completing its control stroke $h_1$, cooperates with the step 39*a* of the counterstop 39 which limits the full-load position of the regulator rod 36. As a result of the operational position described for the limit stop 16, the full-load-positions of the regulator rod 36 limited by the curve portion C-D-H also cannot be exceeded any longer when the rpm, during engine operation, fall far below the rpm level $n_1$, and the regulator rod 36 is also limited to the full-load position when the engine speed is dropping, corresponding to point C, as a result of the curve c until the engine stops at the point indicated by K.

When the engine is at operational temperature, the exaspsible element 25 has moved the control pin 23 to the extent of the identical control stroke $h_1$ as can be controlled by means of the engine oil pressure, so that during a warm start of the engine the starting quantity remains limited to the full-load quantity in accordance with the curve portion c between points K and C.

The limitation of the starting quantity described above for the cold or the warm engine is also valid for the second embodiment according to FIG. 2. In this embodiment, only the full-load curve extends between rpm levels $n_1$ and $n_V$ in accordance with the thickly drawn curve a between points D-E-F. The shutoff of regulation or deregulation occurs between F and G. The supply quantity increase controlled by the charge-pressure-dependent stop 42 extending between rpm levels $n_1$ and $n_2$ between points D and E, or the corresponding lifting of the regulator rod position R, occurs in the embodiment of the control apparatus 12 in accordance with the invention independently of its temperature- and control-pressure-dependently controlled correction of the starting quantity.

In the third embodiment shown in FIGS. 3–5, the full-load position of the regulator rod 36, as in the second embodiment according to FIG. 2 is controllable in accordance with charge pressure between rpm levels $n_1$ and $n_2$ or between points D and E. As may be seen from FIGS. 3 and 4, the position of the regulator rod 36 may, however, be withdrawn for the purpose of controlling the starting quantity between the maximal regulator rod position characterized by the curve portion A-B down to the thickly drawn broken line curve e between points N and O. Such a position is shown in FIG. 3, while the starting position for the cold engine corresponding to the curve portion A-B is indicated in dot-dash lines. The starting quantity course for the warm engine indicated by the curve portion e in FIG. 6, in which the limit stop 53 stands in the position shown in FIG. 4, is maintained up to the rpm level corresponding to point O; above this rpm level, however, the control piston 14' is displaced into its position shown in FIG. 5 by the engine oil pressure and has compressed the limit stop 53 into its terminal position in which the starting detent 55 is not in engagement with the regulator rod 36. In the operational position of the limit stop 53 shown in FIG. 5, only the full-load stop 51*a*, together with step 39*a* of the counterstop 39, determines the largest possible regulator rod position corresponding to a course of the curve between the points K-C-D-E-F in FIG. 6.

The foregoing relates to preferred embodiments of the invention, it being understood that other embodiments and variants thereof are possible within the spirit and scope of the invention, the latter being defined by the appended claims.

What is claimed and desired to be secured by Letters Patent of the United States is:

1. A control apparatus for limiting the fuel supply quantity of a fuel injection pump for internal combustion engines such as Diesel engines or the like having a fuel supply quantity adjustment member comprising, in combination, a housing, a return spring, a first control member actuatable by the rpm-dependent pressure of a control medium, a limit stop having a starting detent displaceable against the force of said return spring and through said control member, said limit stop having one terminal position effected only by said return spring and arranged to assume a position which determines the starting position and having another terminal position controlled by the pressure of the control medium for determining the full-load position of said injection pump supply quantity adjustment member, said limit stop starting detent being arranged to vary its effective length in accordance with temperature, a full-load stop which limits the full-load position of said fuel supply quantity adjustment member when the engine is running and which releases the starting position of said fuel supply quantity adjustment member when the engine is stopped or is starting, said starting detent being arranged to limit the position of said fuel supply quantity adjustment member independently of the setting of said full-load stop when the operationally warm engine is starting to a starting position which does not exceed the full-load position.

2. A control apparatus in accordance with claim 1 wherein said first control member comprises a hydraulically actuatable control piston, said limit stop being connected to said piston which is displaceable perpendicularly to the direction of movement of said fuel supply quantity adjustment member, said temperature-dependent starting detent including an expansible element having a control pin, said control pin serving simultaneously as said full-load stop and disposed coaxially within said control piston.

3. A control apparatus in accordance with claim 2, including a deviation piston guided coaxially within said control piston, a deviation spring for retaining said deviation piston in a position of rest, and wherein said expansible element is secured within said deviation piston.

4. A control apparatus in accordance with claim 3 including a stroke limit stop attached to said housing, and wherein said control pin has a temperature-dependent control stroke ($h_1$) limited by said stroke limit stop.

5. A control apparatus in accordance with claim 4 including a restraining spring 26 for permitting an expansion of the expansible element beyond said control stroke ($h_1$), said restraining spring being arranged to retain the expansible element in its installed position.

6. A control apparatus in accordance with claim 5, including an adjustable stop lever for acting upon said fuel supply quantity adjustment member, said stop lever being adjustable in accordance with a further operational value of the engine, and wherein said control pin is actuatable in accordance with rpm and temperature.

7. A control apparatus in accordance with claim 6 including a second control member and wherein said stop lever is of hook-shaped configuration having one leg, said stop lever being disposed at least approximately parallel to said fuel supply quantity adjustment member and whenever the end of said one leg is articulatedly connected to said control member, a counterstop mounted on said fuel quantity adjustment member, said first control member being arranged to act pivotably on said one leg, said stop lever being provided with another leg having an end movable into the path of said counterstop to thereby limit the full-load position of said fuel supply quantity adjustment member when said control pin of said first control member is displaced in accordance with pressure and/or temperature.

8. A control apparatus in accordance with claim 1 wherein said limit stop actuatable by the control member is displaceable perpendicularly to the direction of movement of said fuel supply quantity and adjustment member, a bearing shaft, said limit stop being pivotable about said bearing shaft disposed in its direction of adjustment, and a second control member for pivotally moving said limit stop in accordance with a further operational value of the engine for the purpose of varying the full-load position of said full-load stop, said temperature-dependent starting detent being adjustably mounted within said limit stop perpendicular to the longitudinal axis of said limit stop in the direction of movement of said fuel supply quantity adjustment member, said starting detent being arranged to cooperate with said second counterstop when said limit stop is in the starting position, and said full-load stop being mounted in the direction of displacement of said limit stop, laterally recessed with respect to the starting detent, said full-load stop being arranged to cooperate with said first counterstop on said fuel supply quantity adjustment member when said limit stop is in its terminal position so as to determine the full-load position of said fuel supply quantity adjustment member.

* * * * *